US008596378B2

(12) United States Patent
Mason et al.

(10) Patent No.: US 8,596,378 B2
(45) Date of Patent: Dec. 3, 2013

(54) PERFORATING SAFETY SYSTEM AND ASSEMBLY

(75) Inventors: Justin Lee Mason, Denton, TX (US); John Hales, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 339 days.

(21) Appl. No.: 12/957,575

(22) Filed: Dec. 1, 2010

(65) Prior Publication Data

US 2012/0138286 A1 Jun. 7, 2012

(51) Int. Cl.
*E21B 43/119* (2006.01)

(52) U.S. Cl.
USPC ..... 175/4.51; 166/297

(58) Field of Classification Search
USPC ..... 175/1–4.6; 166/296–298
See application file for complete search history.

(56) References Cited

U.S. PATENT DOCUMENTS

| | | | | |
|---|---|---|---|---|
| 2,644,519 | A * | 7/1953 | Kanady | 175/4.53 |
| 2,924,173 | A * | 2/1960 | Robertson | 175/4.53 |
| 4,011,815 | A | 3/1977 | Garcia | |
| 4,172,421 | A | 10/1979 | Regalbuto | |
| 4,194,577 | A * | 3/1980 | Vann | 175/4.51 |
| 4,292,895 | A | 10/1981 | Bell et al. | |
| 4,306,628 | A * | 12/1981 | Adams et al. | 175/4.56 |
| 4,319,526 | A | 3/1982 | DerMott | |
| 4,523,650 | A | 6/1985 | Sehnert et al. | |
| 4,693,308 | A | 9/1987 | Luke et al. | |
| 4,727,810 | A | 3/1988 | Furst et al. | |
| 5,027,708 | A | 7/1991 | Gonzalez et al. | |
| 5,159,145 | A | 10/1992 | Carisella et al. | |
| 5,165,489 | A | 11/1992 | Langston | |
| 5,223,665 | A | 6/1993 | Burleson et al. | |
| 5,237,136 | A | 8/1993 | Langston | |
| 5,346,014 | A | 9/1994 | Ross | |
| 5,392,860 | A | 2/1995 | Ross | |
| 5,632,348 | A | 5/1997 | Yunan | |
| 5,911,277 | A * | 6/1999 | Hromas et al. | 166/297 |
| 6,095,258 | A | 8/2000 | Reese et al. | |
| 6,105,688 | A | 8/2000 | Vaynshteyn et al. | |
| 6,540,029 | B2 | 4/2003 | Snoeys et al. | |
| 7,387,156 | B2 | 6/2008 | Drummond et al. | |
| 7,428,922 | B2 | 9/2008 | Fripp et al. | |
| 7,487,833 | B2 | 2/2009 | Grigar et al. | |
| 7,690,287 | B2 | 4/2010 | Maegerlein et al. | |
| 2007/0107893 | A1 | 5/2007 | Drummond et al. | |
| 2009/0151588 | A1 * | 6/2009 | Burleson et al. | 102/310 |

FOREIGN PATENT DOCUMENTS

WO 2012074767 6/2012

OTHER PUBLICATIONS

International Patent Application No. PCT/US2011/061170, "International Search Report and Written Opinion", mailed Jul. 19, 2012 (12 pages).

* cited by examiner

*Primary Examiner* — Shane Bomar
*Assistant Examiner* — Kipp Wallace
(74) *Attorney, Agent, or Firm* — Kilpatrick Townsend & Stockton LLP

(57) ABSTRACT

Perforating assemblies and perforating safety systems capable of being disposed in a wellbore for hydrocarbon fluid production are described. The perforating assemblies can include an isolation device that is capable of preventing a denotation train when the assemblies are in a first orientation and allowing a denotation train when the perforating assemblies are in a second orientation. The isolation device can be automatically reoriented or reconfigured upon a change in the orientation of the perforating assembly.

8 Claims, 3 Drawing Sheets

PERFORATING SAFETY SYSTEM AND ASSEMBLY

TECHNICAL FIELD OF INVENTION

The present invention relates generally to equipment and procedures used in conjunction with subterranean wells, and more particularly (although not necessarily exclusively), provides a safety system for use in perforating operations.

BACKGROUND

Perforating typically involves the use of shaped charges in a perforating gun to form perforations or openings through casing in a well. Detonation of the shaped charges is initiated by a device known as a firing head. The firing head may be operated mechanically, electrically, by application of pressure, or via various forms of telemetry. These perforations or openings that are formed are provided such that oil or gas can flow into production tubing.

A significant concern within the industry relates to the prevention of unintended detonation of a perforating device, and particularly any detonation at the surface level. The force or energy associated with such a detonation of a perforating device is significant and one which could cause serious injury to not only an operator or handler of the specific device but also anyone or any surrounding property within a general radius of the detonation.

Existing safety devices commonly rely upon temperature and/or pressure. The perforating devices using these safety devices are not armed until the device is exposed to sufficient temperature and/or pressure, which is often those temperatures or pressures experienced in a downhole environment. With the increased frequency of the operation of deviated, highly deviated, or horizontal wells, other perforating safety systems are desired. In some such wells, for example, the necessary temperature conditions and/or pressure conditions may not be experienced within a deviated or horizontal section of the wellbore. Therefore, assemblies and systems are desirable that can provide alternative perforating safety systems for use in a deviated, highly deviated, or horizontal well, which can be independent of temperature and/or pressure conditions and can provide effective protection from unintended detonations, particularly at the surface level or in a vertical section of a well.

SUMMARY

Certain embodiments described herein are directed to a perforating assembly and a perforating safety system. The perforating assembly and perforating safety system can be disposed in a bore of a subterranean formation.

In some embodiments, the perforating assembly can comprise an isolation device. The isolation device can prevent a denotation train when the perforating assembly is in a first orientation and can allow a denotation train when the perforating assembly is in a second orientation. The isolation device can automatically switch from a first configuration to a second configuration upon a change in orientation of the perforating assembly, for example much like that experienced when being conveyed from a vertical section of a well to a horizontal section of a well.

In at least one embodiment, the isolation device can provide an obstruction to interrupt the detonation train when the perforating assembly is in the first orientation.

In some embodiments, the isolation device can include a substantially spherical structure. The substantially spherical structure can cooperate with a sealing device to prevent the detonation train when the perforating assembly is in the first orientation. In some embodiments, the substantially spherical structure can be positioned in a second position when the perforating assembly is in the second orientation. In certain embodiments, the sealing device can be at least one of an O-ring, a gasket, or a material made from silicone.

In at least one embodiment, the isolation device can include a weighted swivel structure. The weighted swivel structure can automatically rotate upon the perforating assembly being changed from the first orientation to the second orientation. In some embodiments, the weighted swivel structure can include a block that provides an obstruction to interrupt the detonation train when the perforating assembly is in the first orientation.

In at least one embodiment, the weighted swivel structure can include a ballistic train. The ballistic train can aid the detonation of the perforating assembly when the perforating assembly is oriented in the second orientation.

In other embodiments, a perforating safety system for use in a subterranean well is provided. The system includes an isolation device that can be positioned within a chamber. The isolation device can have at least a first configuration and a second configuration within the chamber. The isolation device can prevent a transfer of detonation when positioned in the first configuration and can allow a transfer of detonation when positioned in the second configuration.

In at least one embodiment, the isolation device can be positioned between a perforating gun and a firing head. In some embodiments, the perforating safety system can include a plurality of isolation devices.

In at least one embodiment, the isolation device can provide an obstruction to interrupt the transfer of detonation when positioned in the first configuration.

In at least one embodiment, the isolation device can provide a ballistic train to allow the transfer of detonation when positioned in the second configuration.

In yet other embodiments, a perforating safety system for use in a subterranean well is provided. The system can include a perforating assembly that includes a perforating gun, a firing head, and an isolation device. The isolation device can selectively prevent transfer of detonation from the firing head to the perforating gun.

In at least one embodiment, the isolation device can be positioned in a configuration to allow the transfer of the detonation.

In at least one embodiment, the configuration of the isolation device is gravity-dependent.

In at least one embodiment, the transfer of detonation can be allowed when the perforating assembly is oriented in a substantially horizontal orientation.

These illustrative aspects and embodiments are mentioned not to limit or define the invention, but to provide examples to aid understanding of the inventive concepts disclosed in this application. Other aspects, advantages, and features of the present invention will become apparent after review of the entire application.

DETAILED DESCRIPTION

Figure 1:
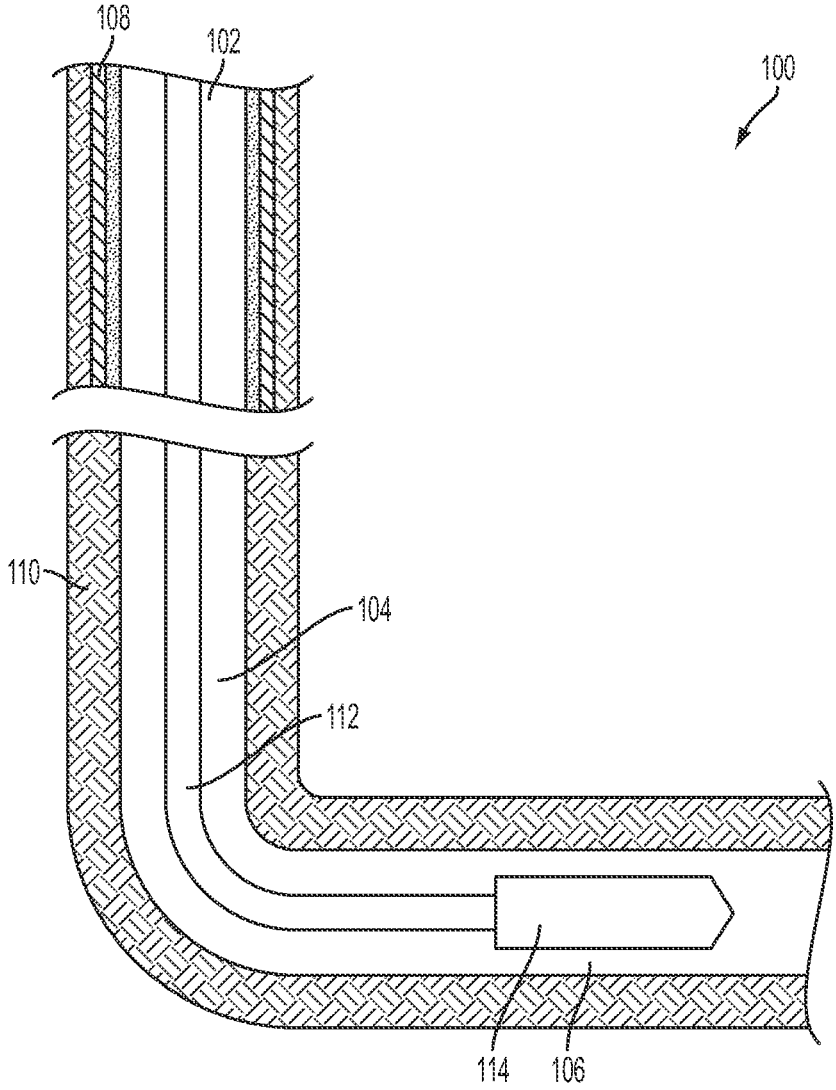
FIG. 1 is a schematic illustration of a well system having a perforating assembly according to one embodiment of the present invention.

Certain aspects and embodiments of the present invention relate to perforating safety systems that are capable of being disposed in a bore, such as a wellbore, or a subterranean formation for use in producing hydrocarbon fluids from the formation. In some embodiments, the perforating assembly and perforating safety system can include an isolation device that can prevent a denotation train and selectively allow a denotation train, depending on the orientation of the assembly and the isolation device.

With the increased frequency of the operation of deviated, highly deviated, or horizontal wells, a perforating safety system that relies on variables other than temperature or pressure are desired. As used herein, the terms "deviated well" or "highly deviated well" refer to a well or a section of a well that is deviated from a vertical orientation. As used herein, the terms "horizontal well" or "horizontal section of a well" refer to a well or section of a well that is deviated from a vertical orientation in a generally horizontal orientation, for example, at an angle from about 65 degrees to about 130 degrees, relative to the ground surface, or more often, a well or section of a well that is oriented at about a 90 degree angle in relation to the ground surface. Some embodiments described herein refer to perforating assemblies and perforating safety systems that can be utilized in a horizontal well or a horizontal section of well; although not specifically stated, some of the same such embodiments may be utilized in a deviated or highly deviated well or well section.

Described herein are perforating assemblies and perforating safety systems that utilize the orientation of the perforating assembly within a horizontal well or a horizontal section of a wellbore to provide a safety mechanism. The perforating assemblies and perforating safety systems described herein can provide a safer device that operates independently of conventional safety measures or variables such as temperature or pressure conditions.

Equipment that is used downhole within a wellbore is generally introduced to the wellbore in a vertical orientation. As a piece of equipment is lowered within the wellbore, the orientation of the equipment remains substantially consistent in a vertical section of a wellbore. Upon transitioning from a vertical section of a wellbore to a horizontal section, the equipment is re-oriented to a second configuration or orientation.

After the perforating assembly is run downhole to a desired position, a firing head can be initiated for detonation. The denotation train can then be transferred to the perforating gun portion of the assembly. The shaped charge within the perforating gun can be detonated to pierce or create openings within a casing in a wellbore. The terms "detonation," "denotation train," or "transfer of detonation," as used herein, includes a transfer of energy by detonation, deflagration, ignition, burning, or other exothermic transfers of energy.

Described herein are assemblies and systems that selectively allow a perforating assembly to fire based upon the orientation of the assembly. In some embodiments, the assemblies and systems comprise an isolation device that can interrupt an explosive train or transfer of detonation at specific points within the denotation train of the perforating assembly.

The illustrative examples are given to introduce the reader to the general subject matter discussed herein and not intended to limit the scope of the disclosed concepts. The following sections describe various additional embodiments and examples with reference to the drawings in which like numerals indicate like elements and directional description are used to describe illustrative embodiments but, like the illustrative embodiments, should not be used to limit the present invention.

FIG. 1 depicts a well system 100 with a perforating assembly 114 according to certain embodiments of the present invention. The well system 100 includes a bore that is a wellbore 102 extending through various earth strata. The wellbore 102 has a substantially vertical section 104 and a substantially horizontal section 106. The substantially vertical section 104 includes a casing string 108 cemented at an upper portion of the substantially vertical section 104. In some embodiments, a substantially vertical section may not have a casing string. The substantially horizontal section 106 is open hole and extends through a hydrocarbon bearing subterranean formation 110. In some embodiments, a substantially horizontal section may not be open hole.

A tubing string 112 extends from the surface within the wellbore 102. The tubing string 112 can provide a conduit for formation fluids to travel from the substantially horizontal section 106 to the surface. The tubing string 112 can be used to convey a perforating assembly 114, as well as other equipment or devices, into the well. In some embodiments, coiled tubing, wire line or electrical line, and/or slick line can be used to convey a perforating assembly or other equipment or devices into a well.

FIG. 1 depicts a wells system having a perforating assembly 114 positioned in the substantially horizontal section 106. A perforating assembly can be located in any portion of a well system, including in a substantially vertical portion of a well system that is only a substantially vertical well system. Any number of perforating assemblies can be used in a well system. Some embodiments described herein are useful in the horizontal section of a wellbore.

Figure 2:
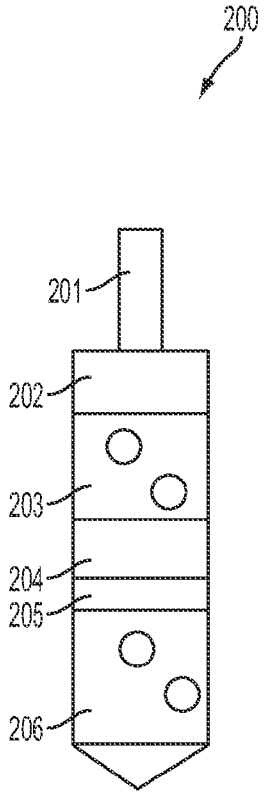
FIG. 2 is a cross-sectional side view of a perforating assembly according to one embodiment of the present invention.

FIG. 2 depicts a cross section of a perforating assembly 200 that can be employed for use in a well. The perforating assembly 200 can comprise a firing head 201, a first isolation device structure 202, a first perforating gun 203, a second isolation device structure 204, and a second perforating gun 206. In other embodiments, the perforating assembly may comprise a single perforating gun and an isolation device structure. In some embodiments, a spacer can be employed, for example, between the firing head and a perforating gun, or other positions. The perforating gun may be of conventional design and may include one or more shaped charges (not shown) which are detonated to perforate casing in the wellbore. In some embodiments, the perforating assembly may include a single perforating gun. In other embodiments, the perforating assembly may include multiple perforating guns, such as two or more. The perforating assembly 200 may also include other elements, such as a detonating cord or other device that has the ability to further a detonation train, boosters, and other types of detonation transfer components.

In some embodiments, a perforating assembly comprises multiple detonating cords spanning from a first perforating gun to a second perforating gun. A booster or plurality of boosters can be employed to transfer the detonation train from the first perforating gun to the second perforating gun. In some embodiments, the perforating guns can be arranged serially such that detonation transfers from one perforating gun to a second perforating gun.

The firing head 201 may be of conventional design. Any method of actuating the firing head 201 may be used, such as application of a predetermined pressure, transmission of a pressure, electrical or telemetry signal, mechanical actuation, or other methods. As shown in FIG. 2, the firing head 201 is positioned at a first end of the perforating assembly 200. The firing head could be otherwise positioned, for example in an intermediate position within a perforating assembly, or at a second end of the perforating assembly. In other embodiments, more than one firing head can be employed in the perforating assembly. The firing head 201 can comprise a primary explosive that can be triggered by an initiator and/or a firing pin. The primary explosion is the initial explosion used to start the detonation train that ultimately ignites a secondary explosion in the perforating gun.

The isolation device structure 202 is positioned between the firing head 201 and the perforating gun 203. The isolation device structure 202 is used to prevent unintended transfer of detonation from the firing head 201 to the perforating gun 203. The isolation device structure 204 is positioned between the firing head 201 and the perforating gun 206 to prevent unintended transfer of detonation from the firing head 201 to the perforating gun 206.

The isolation device structures 202 and 204 can maintain a sufficient barrier or obstruction between the detonation train components to prevent, or otherwise impede, transfer of detonation between the detonation train components. Upon manipulating or re-orienting the perforating assembly, the isolation device structures 202 and 204 can be reconfigured to allow the transfer of detonation. In some embodiments, the reconfiguring of the isolation device structure is gravity-dependent. As further described in connection with the embodiments shown in FIGS. 3A and 3B and those shown in FIGS. 4A and 4B, the isolation device structure can prevent the transfer of detonation between components when the perforating assembly is oriented in a first orientation and allows the transfer of detonation between components when the perforating assembly is oriented in a second orientation.

Figure 3A:
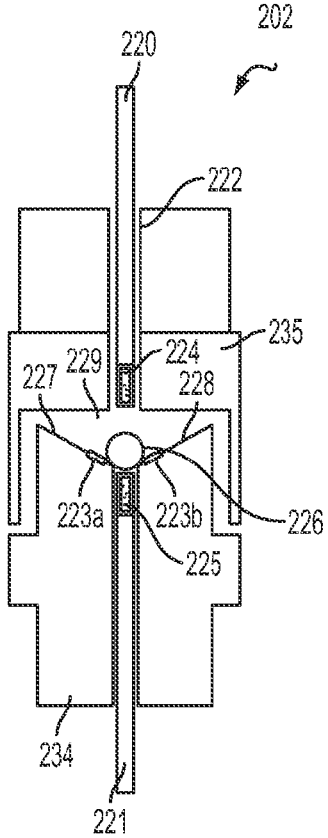
FIG. 3A is a cross-sectional side view of a perforating assembly in a first orientation showing an isolation device according to one embodiment of the present invention.

Referring to FIG. 3A, an enlarged scale cross-sectional view of the isolation device structure 202 is shown. The isolation device structure 202 is shown in a first orientation, here a vertical orientation. A first member 235 cooperates with a second member 234 to provide a chamber 229. The first member 235 and the second member 234 can comprise mateable structures and/or surfaces to provide a sufficiently secure fit or connection. The first member 235 and the second member 234 each comprise a bore 222 through which a first detonating cord 220 and a second detonating cord 221 can be positioned. The first detonating cord 220 has a booster 224 positioned at an end closest to the chamber 229. The second detonating cord 221 has a booster 225 positioned at an end closest to the chamber 229.

The isolation device structure 202 includes an isolation device. In the embodiment shown in FIG. 3A, the isolation device comprises a sphere 226. The sphere 226 provides a physical obstruction or structure that separates the first detonating cord 220 and the second detonating cord 221. In some embodiments, the sphere 226 can be comprised of steel or aluminum. When the perforating device is in the first orientation shown in FIG. 3A, the obstruction or separation can provide a mechanism that interrupts a detonation train of the perforating assembly.

The sphere 226 is seated or positioned in the opening as defined by the first sloped surface 227 and the second sloped surface 228. The sphere 226 is seated upon a sealing device 223*a* and 223*b*, for example an O-ring, a gasket, or other material comprised of silicone. The sphere 226 and the sealing device 223*a* and 223*b* can provide a sufficient barrier such that in the event the first detonating cord 220 and booster 224 detonate, the seal between the sphere 226 and the sealing device 223*a* and 223*b* can prevent the detonation of the booster 225 and the second detonating cord 221. In other embodiments, a sealing device may be absent from the isolation device structure. In such other embodiments, the sphere, or other isolation device, can provide a sufficient barrier, in the absence of a sealing device, to prevent the transfer of detonation.

Figure 3B:
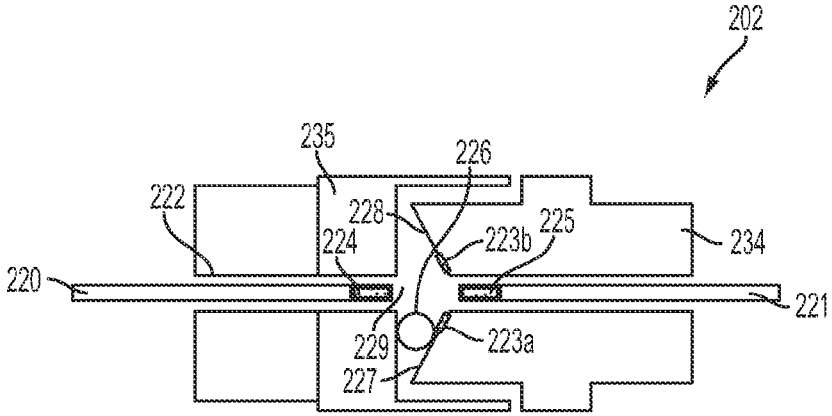
FIG. 3B is a cross-sectional side view of the perforating assembly shown in FIG. 3A in a second orientation showing an isolation device according to one embodiment of the present invention.

Referring to FIG. 3B, an enlarged scale cross-sectional view of the isolation device structure 202 is shown. The isolation device structure 202 is shown in a second orientation, here a horizontal orientation. The sphere 226 is in a second position within the chamber 229. In the second position, the sphere 226 no longer provides a physical obstruction or creates a separation between the first detonating cord 220 and the second detonating cord 221. Thus, upon the detonation of the first detonating cord 220 and booster 224, the detonation train can continue (or be transferred) to the second detonating cord 221 and booster 225. In FIG. 3B, the sphere 226 can travel along the sloped surface 227. In some embodiments, depending on the orientation of the perforating assembly, the sphere 226 can travel along the sloped surface 228. In other embodiments, the angle of the sloped surface can be adjusted such that the sphere moves into, or out of, a desired position when the perforating assembly is oriented at a predetermined amount of deviation.

FIG. 3B shows the isolation device structure 202 in a substantially horizontal orientation. Such orientation of the perforating assembly, and resulting position of the sphere 226, may be characteristic of a perforating assembly position in a horizontal section of a well, for example, much like the position shown in FIG. 1. In some embodiments, the perforating assembly could be positioned in a section of a well that has an angle of about 65 degrees to about 130 degrees. The sphere or other isolation device may not be in the exact position shown in FIG. 3B; however, such a sphere or other isolation device can be in a position that is no longer seated in the opening having the sealing device 223*a* and 223*b*, and thus is no longer providing an obstruction to prevent the transfer of detonation.

While FIGS. 3A and 3B show a sphere, other shapes of an isolation device can be utilized, for example, a plate, an oval, an obloid, a cylinder, or other shape that provides sufficient energy attenuation to avoid the booster on each side of the chamber from detonating unintentionally. In some embodiments, the isolation devices can be comprised of steel or aluminum.

Figure 4A:
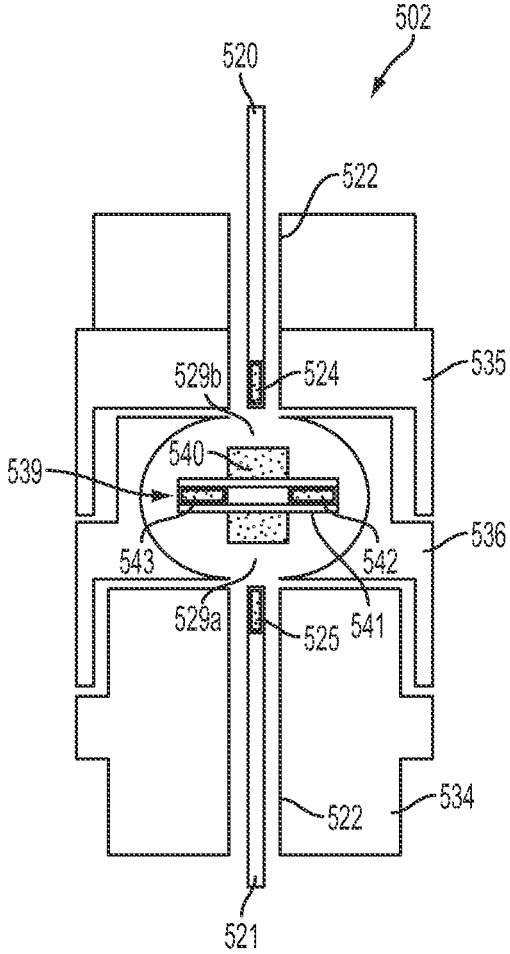
FIG. 4A is a cross-sectional side view of a perforating assembly in a first orientation showing an isolation device according to one embodiment of the present invention.

Referring to FIG. 4A, an enlarged scale cross-sectional view of an alternative embodiment of an isolation device structure 502 is shown. The isolation device structure 502 can be employed in a perforating assembly accordingly to embodiments described herein, for example, in the position of isolation device structure 202 in the embodiment shown in FIG. 2. The isolation device structure 502 is shown in a first orientation, here a vertical orientation. A first member 535 cooperates with a second member 534 and a third member 536. The third member 536 defines a chamber (shown as 529*a* and 529*b*). The first member 535, the second member 534, and the third member 536 can comprise mateable structures and/or surfaces to provide a sufficiently secure fit or connection. The first member 535 and the second member 534 each comprise a bore 522 through which a first detonating cord 520 and a second detonating cord 521 can be positioned. The first detonating cord 520 has a booster 524 positioned at an end closest to the chamber 529*b*. The second detonating cord 521 has a booster 525 positioned at an end closest to the chamber 529*a*.

The isolation device structure 502 includes an isolation device. In the embodiment shown in FIG. 4A, the isolation device comprises a weighted swivel structure 539. The weighted swivel structure 539 comprises a block 540 and a ballistic train 541 having a third booster 542 and a fourth booster 543.

The weighted swivel structure can comprise a weight element. The weight element can cause the reorienting or reconfiguring of the weighted swivel structure upon the perforating assembly being reoriented, for example after being employed further downhole in a horizontal section of a wellbore. In some embodiments, the block 540 can comprise the weight element. The block 540 can be made of a material that does not transfer the detonating charge from the first detonating cord 520 to the second detonating cord 521. Some exemplary materials include, but are not limited to, steel and aluminum.

The weighted swivel structure 539 provides a physical obstruction or structure that separates the first detonating cord 520 and the second detonating cord 521. When the perforating device is in the first orientation shown in FIG. 4A, the obstruction or separation can provide a mechanism that interrupts any transfer of detonation of the perforating device. In some embodiments, the distance between the first detonating cord 520 and the second detonating cord 521 can prevent an effective transfer of detonation.

Figure 4B:
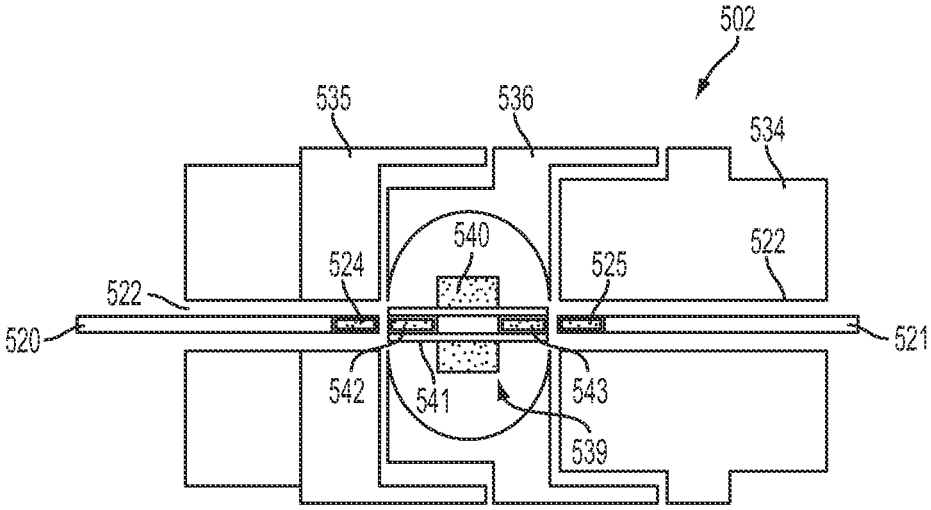
FIG. 4B is a cross-sectional side view of the perforating assembly shown in FIG. 4A in a second orientation showing an isolation device according to one embodiment of the present invention.

Referring to FIG. 4B, an enlarged scale cross-sectional view of the isolation device structure 502 is shown. The isolation device structure 502 is shown in a second orientation, here a horizontal orientation. The weighted swivel structure 539 is in a second configuration that aligns the ballistic train 541 with the first detonating cord 520 and the second detonating cord 521. The third booster 542 and the fourth booster 543 can provide an effective transfer of detonation through the isolation device structure 502. The weighted swivel structure can automatically rotate upon the isolation device structure being reoriented to a second orientation. Similar to the embodiments described above, the weight and tension of the weighted swivel structure can be adjusted such that it is not required for the perforating assembly to be at about a 90 degree angle for the structure to automatically rotate. The weighted swivel structure can be adjusted such that it can rotate when the perforating assembly is oriented at an angle from about 65 degrees to about 130 degrees. The weighted element can drive the configuration of the weighted swivel structure 539 such that the ballistic train 541 is sufficiently aligned with first detonating cord 520 and the second detonating cord 521, i.e. in close enough proximity to transfer the detonation from the booster 524 to the booster 542 and the booster 543 to the booster 525.

The foregoing description of the embodiments, including illustrated embodiments, of the invention has been presented for the purpose of illustration and description and is not intended to be exhaustive or to limit the invention to the precise forms disclosed. Numerous modifications, adaptations, and uses thereof will be apparent to those skilled in the art without departing from the scope of this invention.

What is claimed is:

1. A perforating assembly capable of being disposed in a bore of a subterranean formation, the perforating assembly comprising:

an isolation device that is configured to provide a solid obstruction between the entirety of a first detonation train component and a second detonation train component in a first position, wherein the solid obstruction is configured to prevent a detonation train when the perforating assembly is in a first orientation and is movable to a second position for allowing the first component to directly contact the second component for causing the detonation train when the perforating assembly is in a second orientation, wherein the isolation device comprises a substantially spherical structure.

2. The perforating assembly of claim 1, wherein the isolation device comprises the substantially spherical structure and the substantially spherical structure is configured to cooperate with a sealing device to prevent the detonation train when the perforating assembly is in the first orientation.

3. The perforating assembly of claim 2, wherein the sealing device comprises at least one of an O-ring, a gasket, or a material made from silicone.

4. The perforating assembly of claim 1, wherein the isolation device comprises the substantially spherical structure and the substantially spherical structure is configured to be in the second position when the perforating assembly is in the second orientation.

5. The perforating assembly of claim 1, wherein the isolation device is configured to be in the first orientation or the second orientation depending on gravity.

6. A perforating safety system for use in a subterranean well, the perforating safety system comprising:

a perforating assembly including a perforating gun, a firing head, and an isolation device, wherein the isolation device is configured to (i) provide a solid obstruction at a first position between the perforating gun and the entirety of the firing head, wherein the solid obstruction is configured to selectively prevent transfer of detonation from the firing head to the perforating gun and (ii) be positioned in a configuration to move the solid obstruction to a second position for allowing the transfer of the detonation, wherein the configuration of the isolation device is gravity-dependent.

7. The perforating safety system of claim 6, wherein the isolation device is configured to allow the transfer of the detonation when the perforating assembly is oriented in a substantially horizontal orientation.

8. The perforating safety system of claim 6, wherein the isolation device comprises a substantially spherical structure.

* * * * *